United States Patent [19]

Cratin, Jr.

[11] 4,241,869

[45] Dec. 30, 1980

[54] FURNACE FUEL OPTIMIZER

[75] Inventor: John R. Cratin, Jr., Galveston, Tex.

[73] Assignee: Standard Oil Company (Indiana), Chicago, Ill.

[21] Appl. No.: 2,534

[22] Filed: Jan. 11, 1979

[51] Int. Cl.[3] ..... F22G 5/00

[52] U.S. Cl. ..... 236/15 BR; 122/452; 122/479 R

[58] Field of Search ..... 236/15 E, 15 B, 21 R; 122/504, 452, 479 R

[56] References Cited

U.S. PATENT DOCUMENTS

| | | | |
|---|---|---|---|
| 1,816,311 | 7/1931 | Brown | 236/15 BF |
| 3,769,789 | 11/1973 | Niggeman | 122/479 R |

*Primary Examiner*—William E. Wayner

*Attorney, Agent, or Firm*—Lansing M. Hinrichs; William T. McClain; William H. Magidson

[57] ABSTRACT

This invention relates to an improved furnace fuel optimizer for more effectively controlling fuel consumption in a furnace and a method for using the furnace fuel optimizer. In particular, the invention relates to a furnace fuel optimizer which controls combustion air by maintaining a convective section differential pressure value or a convective section heat duty value while monitoring CO emissions in the flue gas and monitoring the draft below the convective section in order to obtain an optimum control value. The furnace fuel optimizer then regulates the furnace to correspond to the optimum control value by adjusting the air input to the furnace so that continuous furnace operation is possible at maximum efficiency.

16 Claims, 3 Drawing Figures

FURNACE FUEL OPTIMIZER

BACKGROUND OF THE INVENTION

1. Field of the Invention

This invention relates to an improved furnace fuel optimizer for more effectively controlling fuel consumption in a furnace and a method for using the furnace fuel optimizer. In particular, the furnace fuel optimizer is designed to control combustion air by maintaining a convective section differential pressure value or a convective section heat duty value while monitoring CO emissions in the flue gas and monitoring the draft below the convective section in order to obtain an optimum control value. The optimizer then regulates the furnace to correspond to the optimum control value by adjusting the air input to the furnace so that continuous furnace operation is possible at maximum efficiency.

2. Description of the Prior Art

Furnaces, or process heaters as they are sometimes referred to, are used by industries to elevate the temperature of various fluids and gases by passing these fluids and gases through hollow tubular tubes or coils which are enclosed in the furnace. When the fluid or gas absorbs an adequate amount of heat, it is transferred away to another unit for further processing. In an oil refinery, normally over half of the total fuel consumption is attributable to the firing or heating of such furnaces. Most of this heat is used to generate steam or to heat various feed streams, for example, a crude oil feed stream. Since a large percentage of the fuel actually consumed in a refinery is directly related to these furnaces, it is little wonder that the industry has been trying for years to perfect a control apparatus which will increase efficiency. This task has been compounded by such factors as furnace design and configuration, air leakages, burner placement and burner size. In the past, people have tried to provide control to the furnaces by adjusting the fuel to oxygen ratio. This was feasible to a certain extent because the fuel to oxygen ratio provides a predictable correlation over a wide range of fuel oils and gas compositions when excess air is present. To do this, Orsat analysis using carbon dioxide and oxygen percentages was used to calculate the amount of excess air which should be injected into the furnace. Although this method worked, the results were not very reliable, even when oxygen analyzers replaced the Orsat analysis. The reason for this was that an oxygen reading alone could not quickly compensate for any drastic changes which might occur within the furnace. Two other disadvantages of the oxygen analyzer were: (1) if it was located in the furnace's stack, air in-leakage could result in gross distortions of the true excess oxygen in the flame cloud, and (2) if it was located in the firebox, the oxygen would be measured at one location only, when in actuality, a typical firebox contains varying oxygen levels. To date, no one has devised an air input control scheme which can provide maximum efficiency and thereby more effectively control fuel consumption in the furnace.

An object of this invention is to provide a furnace fuel optimizer which will provide maximum fuel efficiency in a furnace.

Another object of this invention is to provide a furnace fuel optimizer which will more effectively control fuel consumption in a furnace.

A further object of this invention is to provide a method for using the furnace fuel optimizer to minimize excess air and fuel consumption.

Still further, an object of this invention is to reduce the cost of operating a furnace by regulating the amount of combustion air to the furnace.

Other objects and advantages will become apparent to one skilled in the art based upon the ensuing description.

SUMMARY OF THE INVENTION

Briefly, the objects of this invention can be realized by using the furnace fuel optimizer for controlling fuel consumption in a furnace. This furnace fuel optimizer is designed for use in a furnace having both a radiant section and a convective section and functions by regulating combustion air to the radiant section in response to an optimum control value. In order for the furnace fuel optimizer to function, the following instruments are needed: a CO analyzer, a draft pressure transmitter and controller, flow transmitters and temperature transmitters, such as thermocouples, and either a differential pressure transmitter or a heat duty measurement device depending on whether a steam generation coil or an economizer coil is present respectively.

The furnace fuel optimizer functions as follows: first, a CO analyzer monitors CO emissions in the departing flue gas and sends a signal to a CO limiter controller. The CO limiter controller compares the measured value to a set point and when, and only when, the measured value exceeds the set point, the CO limiter controller output signal is transmitted to a high signal selector. The CO set point is selected based upon the Environmental Protection Agency's (EPA) recommended standard for the area where the furnace is located. Although the permissible carbon monoxide content in air will vary mainly accordingly to geographical location and population makeup, it will be advantageous to select a CO set point just below the local, state and federal government standards. This will assure compliance with the rules as well as maintaining the economical operation of the furnace. The high signal selector acts to add combustion air to the furnace and this added air will cause the measured variable to decrease to a value below the set point. Second, a draft transmitter monitors the draft below the convective section of the furnace. It is essential for continuous natural draft furnace operation that the pressure immediately below the convective section be less than atmospheric pressure, preferably a pressure of 0.05 inches of water less than atmospheric pressure. A positive pressure below the convective section should be avoided to prevent damage to the furnace. Thirdly, a combustion air controller regulates the air supply to the burners by controlling either the air duct louvers, the fan inlet guide vanes, or the stack damper.

During the optimizing mode, combustion air is gradually reduced until the CO content in the flue gas reaches a set value between 150 and 5000 ppm. As air is reduced, the differential pressure across the steam generation section and/or the heat duty of the economizer coil will decay. At this point the procedure varies depending on whether a steam generation coil or an economizer coil is present. If both exist then either control scheme is feasible, with the steam generation coil method being the preferred.

When a steam generation coil is present, it is necessary to maintain constant flow of the fluid within the coil and this is accomplished by adjusting the flow by means of a flow transmitter connected to a flow controller connected to an automatic control valve, all three being positioned on the coil inlet line. Also a differential pressure transmitter is connected to the inlet and outlet lines of the steam generation coil to monitor variations in pressure across these lines when a substantially constant flow is recorded. The furnace fuel optimizer is able to read the aforementioned instruments and calculate an optimum control value which is then used to regulate the furnace. The optimizer arrives at the optimum control value by allowing the incoming air to be reduced until the CO content in the flue gas reaches a set value just below the permissible EPA standard. When this is achieved, say 1000 ppm, reduction of combustion air ceases and the optimizer reads the corresponding differential pressure (DP) at constant flow and multiplies this value by $M_1$ to obtain an optimum control value hereinafter referred to as DP optimum.

$$\text{Delta DP} \times M_1 = \text{DP optimum}$$

$M_1$ is a number selected by the operator which will vary depending upon the design and construction of each furnace. $M_1$ may be any number between 1.0 and 3.0 but preferably is selected as close to 1.0 as possible without exceeding the furnace's specified maximum bridge-wall temperature, the maximum allowable tube skin temperature and without excessive flame impingement on the tubes. An acceptable $M_1$ value will be readily apparent to the operator after several trial runs.

After the DP optimum value is obtained, the furnace fuel optimizer shifts from the optimizing mode to the run mode during which the optimizer adjusts combustion air by maintaining a constant DP optimum. Maximum practicable efficiency results.

When a non-steaming feed water economizer coil is present, a flow transmitter is positioned on the economizer inlet line along with temperature transmitters on the economizer's inlet and outlet lines. The furnace fuel optimizer reads these values and calculates an optimum control value which again is used to regulate the furnace. The furnace fuel optimizer arrives at the optimum control value by allowing the incoming air to be reduced until the CO content in the flue gas reaches a set value just below the permissible EPA standard. It then reads the temperature transmitters and flow transmitter and calculates a heat duty value $Q_1$. $Q_1$ is equal to the mass flow rate times delta T ($\Delta T = T_{out} - T_{in}$) times the specific heat of the material flowing through the economizer coil.

$$Q_1 = \text{mass flow rate} \times \text{delta T} \times \text{specific heat of material}$$

The optimizer then computes an optimum control value by multiplying $Q_1$ by $M_2$. $M_2$ is again a number selected by the operator which is greater than 1.0 but less than 3.0 preferably close to 1.0. $M_2$ like $M_1$ is a number which will vary depending upon the design and construction of each furnace. However, an acceptible $M_2$ value will be readily apparent to the operator after several trial runs. When the heat duty value $Q_1$ is multiplied by $M_2$ it will yield an optimum control value. $M_2$ like $M_1$ is selected as close to 1.0 as possible without exceeding the furnace's specified maximum bridgewall temperature, the maximum allowable tube skin temperature and without excessive flame impingement on the tubes.

The furnace fuel optimizer will then regulate air flow into the radiant section in response to the optimum control value and thereby allow the furnace to operate more efficiently. When a furnace is operated at the most effective fuel-air ratio its efficiency will increase and its cost of operation will decrease.

DETAILED DESCRIPTION OF THE INVENTION

Figure 1:
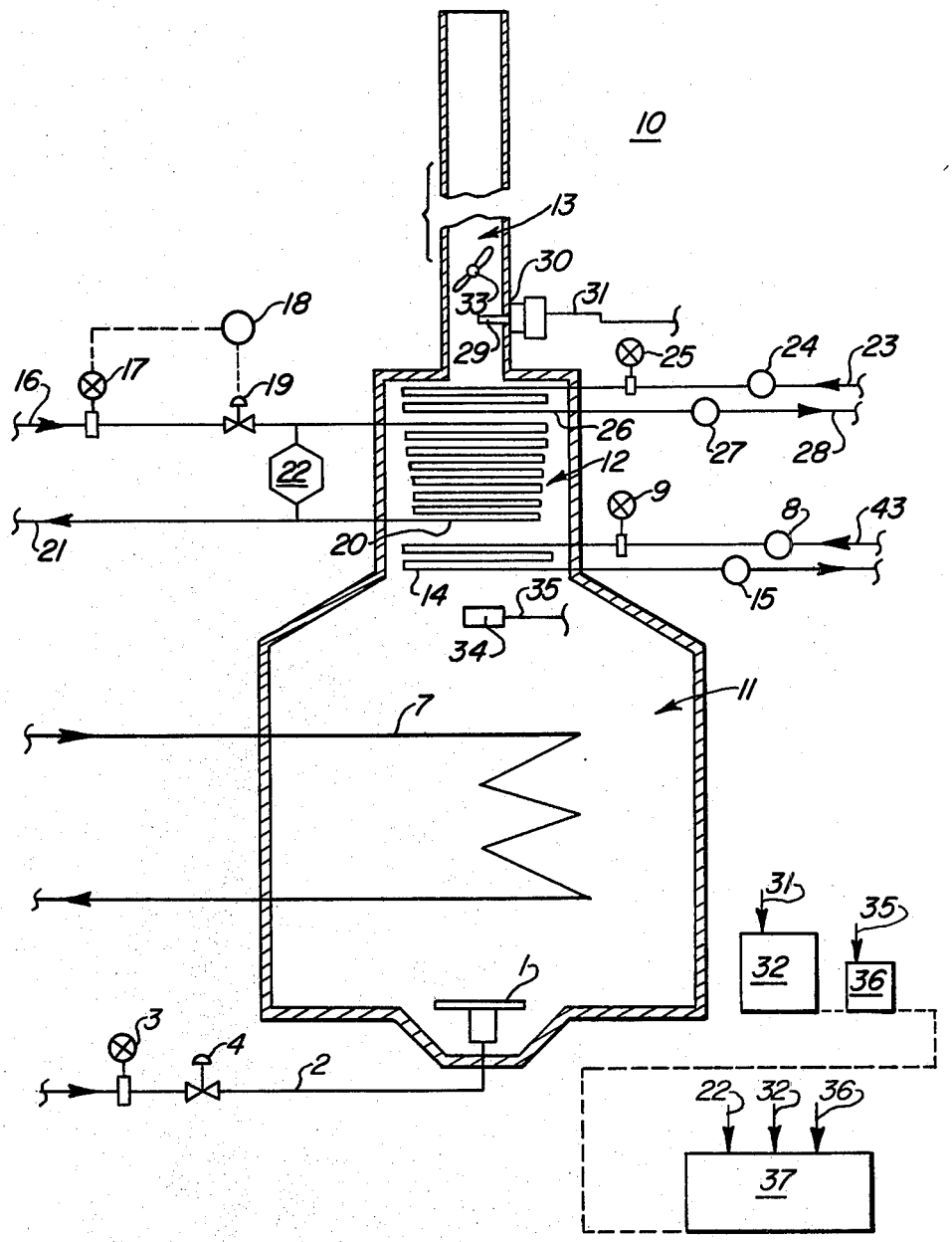
FIG. 1 is a schematic diagram of a furnace having a radiant section, a convective section and a furnace fuel optimizer.

FIG. 1 shows furnace 10 which can be either a single cell or a multicell industrial furnace having radiant section 11 and convective section 12. The word furnace, as used hereinafter, will include any natural draft or pressured apparatus in which heat is liberated by the combustion of fuel within an internally insulated enclosure. Some typical names used to identify such furnaces are: process heaters, process furnaces, fired heaters, and direct-fired heaters. Commonly, these furnaces have one or more banks of hollow tubular heating coils arranged about the interior as well as along the walls and ceiling of both sections for the purpose of passing a fluid or gas through them which is to be elevated in temperature. The hollow tubular heating coils, 7, 14, 20 and 26 pass into and out of either radiant section 11 or convective section 12 and contain a steady flow of fluid or gas which when heated will be used in various refinery processes. A common example is the use of the heated steam to run turbines. Generally, these furnaces should operate to accomplish their task without incurring the problem of localized overheating of the passing fluid or gas.

In FIG. 1, fuel is fed to burner 1 via line 2 having fuel indicator 3 and control valve 4 positioned on it. Burner 1 can consist of one or more burners located on the floor, sides or the roof of radiant section 11. Combustion air to burner 1 is controlled by furnace fuel optimizer 37 which can regulate stack damper 33 or the inlet guide vanes on the forced draft or induced draft fans (not shown), by regulating the fan speed or by changing the air duct louver position. The amount of air introduced to burner 1 will control the flame temperature and radiation intensity, as well as the amount of fuel consumed in the furnace. As combustion occurs in burner 1, heat is liberated and dissipates upward past tubular coils 7 located in radiant section 11. Tubular coils 7 are filled with a flowing fluid which is being elevated in temperature. Typical fluids contained in tubular coils 7 include: crude oil, reduced crude oil, reboiler oil, naphtha, hydrocarbons and water. The exact arrangement of tubular coils 7 within furnace 10 is not controlling but a circuitously arranged configuration is most commonly employed.

As the heat rises from burner 1 it is transferred to tubular coils 7 by radiation and proceeds to heat up the material flowing therein. A significant amount of the heat liberated by burner 1 is transferred to tubular coils 7 with the remaining heat passing into convective section 12. Convective section 12 can contain one or more separate and distinct coils depending upon its design.

Some furnaces employ only a steam generation coil while others contain a superheat coil, an economizer coil or any combination of the three coils. The furnace fuel optimizer of this invention will control the furnace when either a steam generation coil or an economizer coil are present. It should be noted that the furnace fuel optimizer operates in two modes, an optimizing mode and a run mode. The optimizing mode functions at the initial startup period and is repeated at the beginning of each new cycle. Each cycle may extend for any desired time period and is manually set by the operator and can be changed at any time. For example, an optimizing cycle can be conducted every hour, every 8 hours, every 24 hours, every 3 days, etc. The optimizing mode is very short and is followed by the run mode for the duration of the cycle. The run mode is continuous except for when the optimizing mode takes over or when an override mechanism, such as a manual adjustment is triggered.

In FIG. 1, as the heat rises it enters convective section 12 shown with superheat coil 14, steam generation coil 20 and economizer coil 26. It is contemplated that the fluid contained in tubular coils 7 will be different from the substance (fluid or gas) contained in tubular coils 14, 20 and 26, preferably a fluid of constant composition capable of exhibiting a phase change. This is not a necessity but usually is the case because furnaces having both a radiant and a convective section (two or more individual coils) tend to be designed so that only the heat transfer of the radiant section can be controlled. In other words, the fluid contained in tubular coils 7 located in radiant section 11 has to be elevated in temperature X degrees, and the fuel and air to burner 1 is adjusted to meet this demand. The substance contained in coils 14, 20 and 26 merely recovers any excess heat before it escapes to the atmosphere. In our diagram, in superheat coil 14, steam for example, at 456° F. and 435 psi is conveyed through line 43 past temperature transmitter 8 and flow transmitter 9 and is heated by convection to about 700° F. at 425 psi. This steam is conveyed away via line 34 having temperature transmitter 15 positioned thereon. Of the remaining heat, a portion of it is recovered by steam generation coil 20. Coil 20 contains a substance introduced through line 16 having flow transmitter 17, flow controller 18 and automatic control valve 19 positioned on it. After the substance is heated it is conveyed away by outlet line 21. Differential pressure transmitter 22 is connected across input line 16 and outlet line 21 so as to measure the pressure drop across these lines. In order to do this accurately, it is necessary to maintain a constant mass flow throughout coil 20. Of the remaining heat, economizer coil 26 is designed to recover much of it. Normally, economizer coil 26 is a non-steaming boiler feed water economizer coil containing water introduced through line 23 having temperature transmitter 24 and flow transmitter 25 positioned thereon.

For the Q optimum case, the liquid is heated up to a temperature below its boiling point and is conveyed away by outlet line 28 having temperature transmitter 27 positioned on it.

The unrecovered heat and flue gases rise upward and out into the atmosphere through exhaust stack 13 which houses a stack damper 33. CO analyzer probe 29 which is located in stack 13 or in a flue gas duct (not shown) contains CO transmitter 30 and is used to monitor CO content in the flue gas. Dual analyzers can be used instead of a single analyzer and their signals can be relayed to high signal selector 42. CO transmitter 30 is connected by line 31 to CO limiter controller 32 whose function will be explained in detail in the descripition to FIG. 2. A draft pressure transmitter 34 positioned at the entrance to convective section 12 is connected by line 35 to draft limiter controller 36 which is designed to prevent the draft below convective section 12 from diminishing to less than −0.05 inches of water. Draft limiter controller 36 is strictly a limiting device and transmits a significant signal to furnace fuel optimizer 37 only when the pressure sensed by draft pressure transmitter 34 is less than −0.05 inches of water. The discussion of significant signals is presented in the discussion of FIG. 2. This draft controlling protection is required for all natural draft furnaces designed for negative pressure. If draft limiter controller 36 interrupts optimization, gradual manual reduction of the air register openings or of the combustion air duct damper opening will restore draft and permit optimization to resume.

Furnace fuel optimizer 37 can utilize a microprocessor, a computer or an analog control means and is designed to regulate the air input to burner 1. This will thereby minimize fuel consumption and maximize the efficiency of furnace 10. The amount of air together with the available fuel will determine combustion efficiency.

Figure 2:
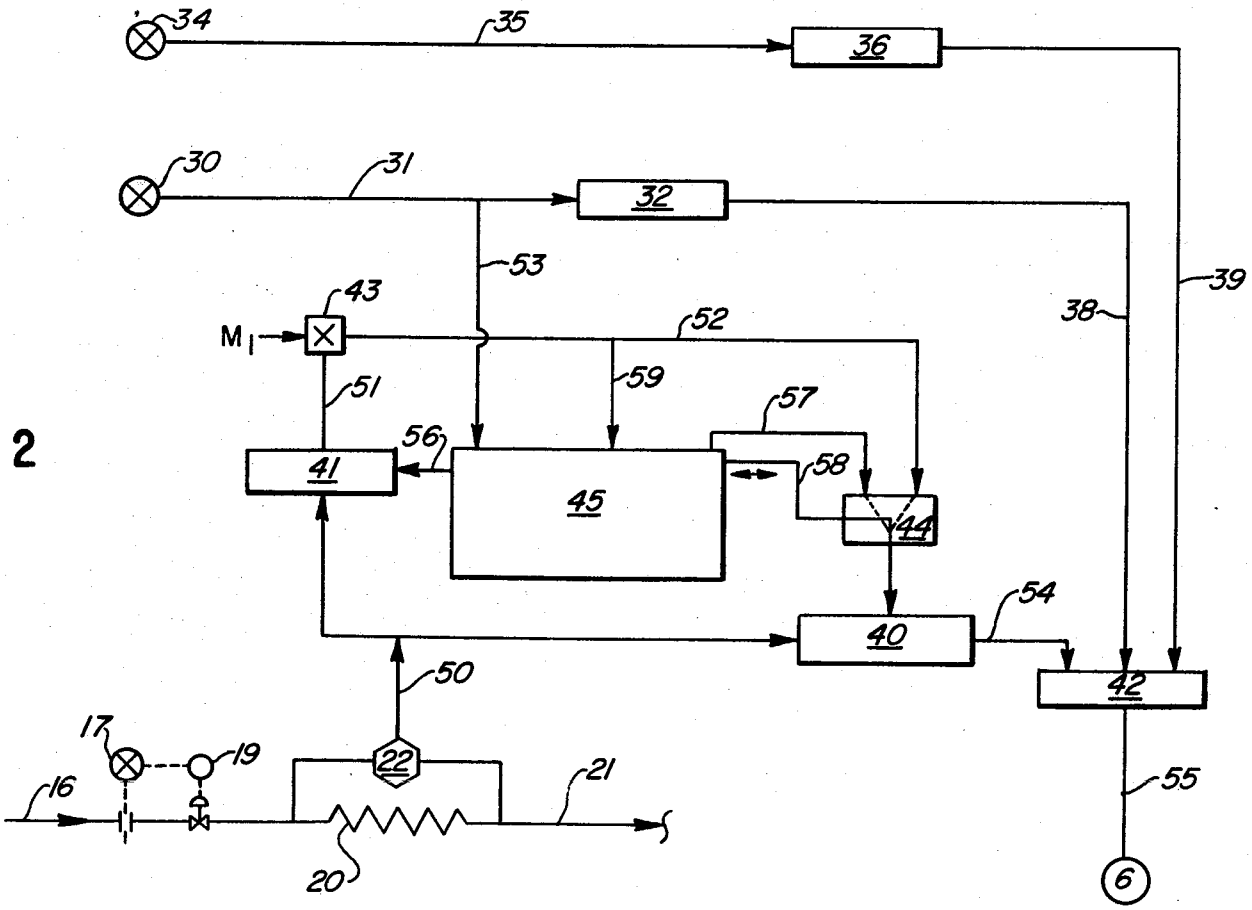
FIG. 2 is a block diagram of the instrumentation scheme using a differential pressure controller.

FIG. 2 shows a block diagram depicting the functional operations of the furnace fuel optimizer having a microprocessor as the control means and using a differential pressure controller. When furnace 10 is equipped with a steam generation coil in convective section 12 and when constant mass flow is maintained through coil 20, it is possible to control the furnace by using a differential pressure variable. The furnace fuel optimizer functions as follows: furnace 10 is first fired and brought on-stream, operating in a desired temperature and pressure mode. The substance (fluid or gas) contained in the radiant and convective section coils, 7 and 20 respectively, is flowing before furnace 10 is fired to insure that no internal parts are damaged. With furnace 10 in operating mode, having adequate draft and excess air, the optimizing cycle begins. The combustion air is gradually reduced while the CO in the flue gas and draft within radiant section 11 are monitored. CO transmitter 30 relays a signal via lines 31 and 53 to CO limiter controller 32 microprocessor 45, respectively. Both CO limiter controller 32 and microprocessor 45 have CO set points, with the set point of microprocessor 45 being much lower than the set point of CO limiter controller 32. The CO set points are arbitrarily selected to correspond to a value equal to or preferrably just below the CO standard set for the area by the Environmental Protection Agency or by a state or local governmental body. Since the CO standards will vary depending upon geographical location, population makeup, climate, etc. regulations and standards for a particular furnace will have to be obtained before a set point is selected. Although any CO value below the governmental requirement can be used, it becomes uneconomical to select a value significantly below the recommended value. When the CO analysis equals the set point of microprocessor 45, optimizing ceases and the differential pressure (DP) is multiplied by $M_1$. $M_1$ is a value arbitrarily selected by the operator, which number is greater than 1.0 but less than 3.0, preferably close to 1.0. $M_1$ can vary depending upon the design and construction of each furnace but an acceptable value will become readily apparent to the operator after several trial runs. $M_1$ when multiplied by a differential pressure value will yield a number (DP optimum) corresponding to a value which is: below said furnace's specified maximum bridgewall temperature, below a maximum allowable tube skin temperature in said radiant section, and is at a value below where excessive flame impingement on said coils occurs. This DP optimum value which is calculated becomes the set point for differential pressure controller 40 and is used to control the furnace during the run mode.

The output signal from CO transmitter 30 which is sent to CO limiter controller 32 is only utilized in the run mode. If for any reason a high CO value is encountered because of increases in fuel supplied during the run mode, CO limiter controller 32 can come into play. Factors such as changes in atmospheric conditions or changes in the charge rate to the furnace can trigger such a high CO value. When, and only when, the CO value exceeds the set point of CO limiter controller 32 does controller 32 begin to send a significant signal to high signal selector 42 to override the output of differential pressure controller 40 and call for more air. At any time when the signal in either lines 38 and 39 exceeds the signal in line 54 from high signal selector 42, a light or alarm will alert the operator that the signal in line 54 is overridden. This condition calls for: (1) adding air manually to eliminate the override and (2) to re-optimize. Simultaneously, draft pressure transmitter 34 measures the draft within the furnace and relays a signal via line 35 to draft limiter controller 36, also having a set point. This set point is arbitrarily selected depending upon the design and construction of each particular furnace. Again the measured value is compared to the set point and an output signal is generated and conveyed to high signal selector 42 via line 39. When the measured value is greater than the set point a significant signal value is transmitted to high signal selector 42. High signal selector 42 is an instrument which has the capability of receiving and comparing several signals simultaneously and will select only the highest signal, disregarding the rest. It should be noted that the signals from CO limiter controller 32 and draft limiter controller 36 are merely limiting detectors and cannot by themselves influence furnace fuel optimizer 37. The third signal from differential pressure controller 40 is the normal governing signal.

At the same time as the above is occurring, differential pressure transmitter 22 monitors changes in pressure across inlet and outline lines 16 and 21 respectively, of steam generation coil 20. This is done after automatic control valve 19 on inlet line 16 has regulated the flow and flow transmitter 17 indicates that a constant mass flow is present. If a constant mass flow within coil 20 is not present, the pressure readings across the coil, will be unreliable. The output signal from differential pressure transmitter 22 is sent via line 50 to Sample and Hold box 41 which is part of microprocessor 45. At the same time, CO transmitter 30 relays a measured value via lines 31 and 53 to microprocessor 45 and since the furnace is already on stream, it will be operating with excess air and adequate draft. Microprocessor 45 calls for gradual reduction of combustion air until the preselected CO set point (say 800 ppm) is observed in the flue gas. At this particular cut off value, which is a number well below the set point in CO limiter controller 32, air reduction ceases and microprocessor 45 instructs Sample and Hold box 41 via line 56 to read the delta differential pressure signal corresponding to the cut off value. Delta differential pressure is equal to the pressure in outlet line 21 minus the pressure in inlet line 16 ($\Delta DP = P_{out} - P_{in}$). Sample and Hold box 41 relays this value via line 51 to multiplication box 43 and instructs multiplication box 43 to multiply the delta differential pressure value by $M_1$ to yield a DP optimum value. Multiplication box 43 relays the calculated value via line 52 to ramp rate box 44. Ramp rate box 44, which has been receiving a signal via line 57 to gradually reduce air, now receives the output signal in line 52. Signal 52 is the new set point for pressure controller 40. Ramp rate box 44 transmits this signal to pressure controller 40 which instructs a gradual change of the set point so as not to abruptly upset the furnace. The signal in line 52 is also sent via line 59 to microprocessor 45 which stores the signal for reference in the next optimizing cycle. For example, assume we are in the run mode controlling DP optimum at 22 psi, which corresponds to a signal of say 32 milliamps in line 52. Microprocessor 45 has stored this signal via line 59 and at the end of the run mode switch 58 instructs ramp rate box 44 to ignore the incoming signal in line 52 and read line 57. Now the optimizing mode has begun and microprocessor 45 gradually reduces the signal in line 57. This reduction in turn causes a reduction in air which will cause the CO content to approach and reach the CO set point of microprocessor 45, say at a differential pressure of 19. If we assume an $M_1$ of 1.06 then signal 52 becomes $19 \times 1.06 = 20.14$ psi. This 20.14 value in line 52 is the new set point for pressure controller 40 but since we do not want to upset the furnace by abruptly changing the set point of pressure controller 40 from 19 psi to 20.14 psi, we sent the signal first to ramp box 44. This box gradually increases the set point to 20.14 psi and the next run mode has started.

The duration of a cycle is selected by the operator and can be changed at any time. In the run mode a substantially constant fluid flow in the steam generation coil is maintained and a substantially constant differential pressure value across the steam generation coil is maintained while both the CO content in the existing flue gas and the draft pressure below the convective section are monitored. The above is accomplished by relaying new incoming values via line 50 from differential pressure transmitter 22 to differential pressure controller 40 where they are compared to the set point value. This comparison is routed via line 54 to high signal selector 42 which in turn relays it via line 55 to air controller 6 for an adjustment if necessary. When the incoming signal via line 50 is greater than the calculated set point in pressure controller 40, a reduction of air will be needed to maximize the efficiency of furnace 10 and a signal is relayed to high selector 42 instructing it to make the change. When the incoming signal via line 50 equals the set point a nominal signal is relayed via line 54 to high signal selector 42. High signal selector 42 will then select the largest of the three incoming signals (from CO controller 32, draft controller 36 and pressure controller 40) and will instruct air controller 6 to maintain its present position. This continuous process of monitoring and comparing recorded values to a calculated set point will continue for the duration of the run cycle. Then another optimization cycle will be performed and the process is repeated again and again.

Figure 3:
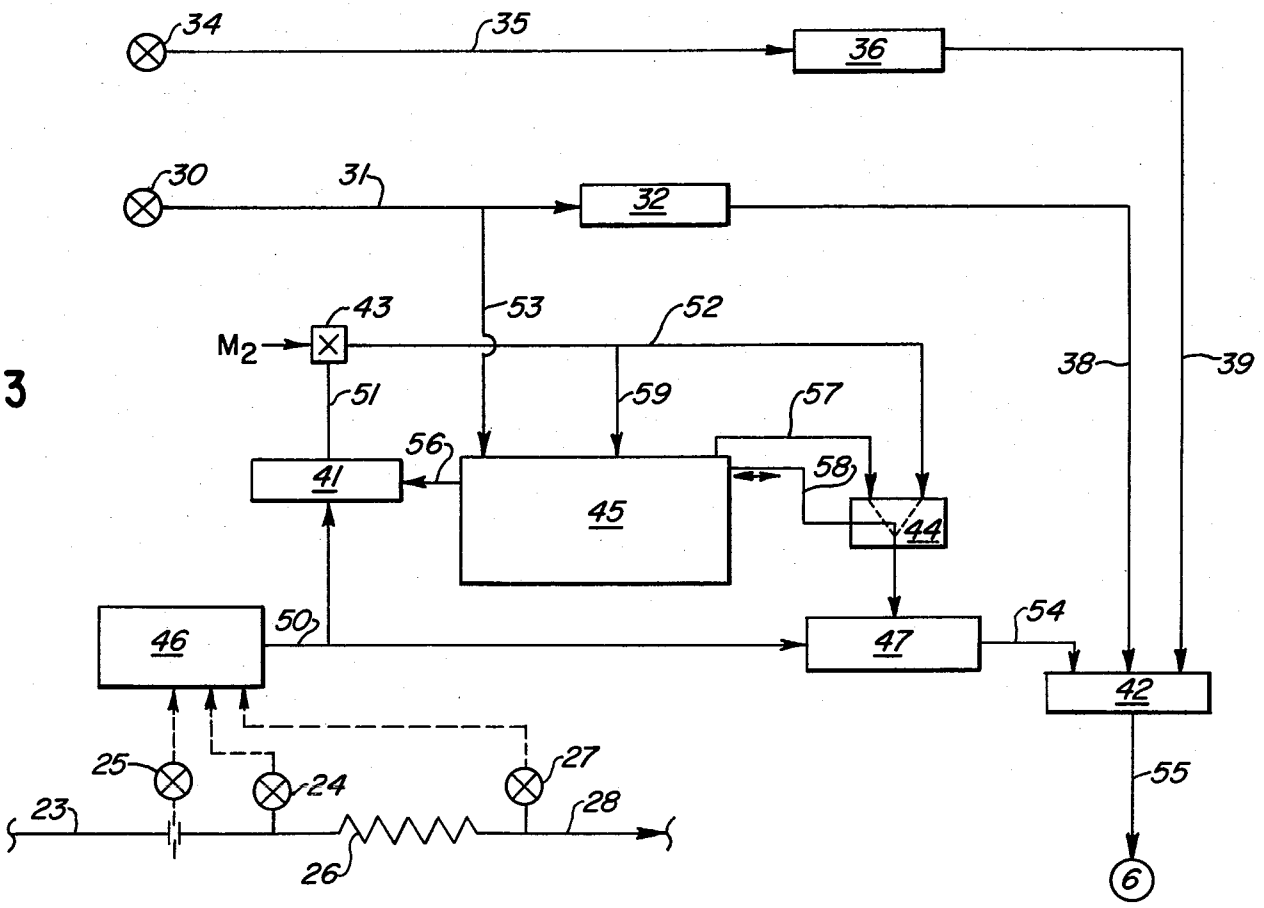
FIG. 3 is a block diagram of the instrumentation scheme using a heat duty control.

FIG. 3 shows a block diagram depicting the functional operations of the furnace fuel optimizer having a microprocessor and using an economizer coil. When a furnace is equipped with an economizer coil, preferably a non-steaming boiler feed water economizer coil, in the convective section and when temperature transmitters are positioned on the inlet and outlet lines of the coil, it is possible to control the furnace by using a heat duty variable (Q). The furnace fuel optimizer functions as follows: the furnace is first fired and brought on-stream, operating in a desired temperature and pressure mode. Preferably water is fed through the economizer coil but any fluid or gas of constant composition incapable of undergoing a phase change can be used under the present conditions. Air input is again gradually reduced and the CO content and draft within the furnace are monitored, compared with selected set points, and the corresponding signals are relayed to high signal selector 42, exactly as described for FIG. 2.

Simultaneously, heat duty generator 46 receives signals from temperature transmitters 24 and 27 positioned on economizer coil 26 inlet and outlet lines 23 and 28 respectively, and a signal from flow transmitter 25. Heat duty generator 46 generates a value $Q_1$ which is the heat duty absorbed by the economizer coil. This value $Q_1$ is obtained by multiplying the input mass flow through inlet line 23 by the specific heat of the flowing material times the difference of the output temperature minus the input temperature. The output temperature is measured by temperature transmitter 27 and the input temperature is measured by temperature transmitter 24. $Q_1$ is then multiplied by $M_2$ to obtain an optimum heat duty value. $M_2$ is a number selected by the operator which will vary depending upon the design and construction of each furnace. $M_2$ like $M_1$ can be any number between 1.0 and 3.0 but preferably is selected as close to 1.0 as possible without exceeding the furnace's specified maximum bridgewall temperature, the maximum allowable tube skin temperature and without excessive flame impingement on the tubes. An acceptable $M_2$ value will be readily apparent to the operator after several trial runs. This optimum heat duty value is then used to control the furnace.

In the optimizing mode, after the furnace has been fired up, heat duty generator 46 sends a signal via line 50 to sample and hold box 41 which is part of microprocessor 45. CO transmitter 30 relays a measured value via lines 31 and 53 to microprocessor 45 and since the furnace is on stream it will be operating with excess air and adequate draft. Microprocessor 45 then instructs automatic control valve 6 to reduce incoming air until a preselected CO content is recorded in the exhaust stack. From here on, the control process for both the optimizing mode and run mode are exactly the same as described for FIG. 2 except heat duty controller 47 replaces differential pressure controller 42. The set point in heat duty controller 47 is determined by flow and temperature rather than pressure.

Although the invention has been described in detail for the purposes of illustration, it is to be understood that such detail is solely for that purpose and that variations can be made therein by those skilled in the art without departing from the spirit and scope of the invention except as it may be limited by the claims.

I claim:

1. An improved furnace fuel optimizer for more effectively controlling fuel consumption in a furnace comprising a radiant section and a convective section containing a steam generation coil by regulating the supply of combustion air to said furnace, wherein the improvement comprises:

(a) a CO analyzer which monitors CO content in exiting flue gas;

(b) a draft pressure transmitter connected to a draft pressure controller which monitors draft below said convective section;

(c) a combustion air controller responsive to a computed optimum differential pressure value for regulating air to said furnace;

(d) a flow transmitter connected to a flow controller which is connected to an automatic control valve, all being positioned on an inlet line to said steam generation coil;

(e) a differential pressure transmitter connected across said steam generation coil inlet and outlet lines so as to monitor variations in differential pressure across said lines;

(f) computing means for computing said optimum differential pressure value for operation of the furnace;

(g) transmission means for transmitting signals from said CO analyzer and from said differential pressure transmitter to said computing means; and (h) means for transmitting said optimum differential pressure value to said combustion air controller.

2. The improved furnace fuel optimizer as described in claim 1 wherein said steam generation coil is separate from coils contained in said radiant section.

3. The improved furnace fuel optimizer as described in claim 2 wherein said steam generation coil contains a fluid of constant composition capable of exhibiting a phase change.

4. The improved furnace fuel optimizer as described in claim 3 wherein said draft pressure controller is a limiting device which can override said furnace fuel optimizer so as to maintain negative pressure below said convective section.

5. The improved furnace fuel optimizer as described in claim 1 wherein said furnace is a pressured furnace.

6. A process for more effectively controlling fuel consumption in a furnace comprising a radiant section and a convective section containing a steam generation coil, wherein the furnace fuel optimizer comprises: a CO analyzer, a draft pressure transmitter and controller, a combustion air controller, a flow transmitter connected to a flow controller which is connected to an automatic control valve, and a differential pressure transmitter connected across said steam generation coil inlet and outlet lines, wherein the optimizing mode of said process comprises the steps of:

(a) supplying fluid to said steam generation coil;

(b) firing said furnace to a desired operating temperature and pressure mode, having adequate draft and excess air;

(c) using said combustion air controller to gradually reduce air to said furnace;

(d) monitoring CO content in exiting flue gas with said CO analyzer;

(e) monitoring draft in said radiant section with said draft pressure transmitter;

(f) relaying said monitored CO content in the exiting flue gas to a control means having a preselected CO value;

(g) ceasing air reduction when said preselected CO value of said control means is met;

(h) reading a corresponding value on said differential pressure transmitter;

(i) multiplying said value by $M_1$ to obtain an optimum differential pressure value, $M_1$ being a value which is greater than 1.0 but less than 3.0 which when multiplied by a differential pressure value will yield a number (DP optimum) corresponding to a value which is: below said furnace's specified maximum bridgewall temperature, below a maximum allowable tube skin temperature in said radiant section, and is at a value below where excessive flame impingement on said coils occurs; and (j) using said optimum differential pressure value to control said furnace.

7. A process for more effectively controlling fuel consumption in a furnace comprising a radiant section and a convective section containing a steam generation coil, wherein the furnace fuel optimizer comprises: a CO analyzer, a draft pressure transmitter and controller, a combustion air controller, a flow transmitter connected to a flow controller which is connected to an automatic control valve, and a differential pressure transmitter connected across said steam generation coil inlet and outlet lines, wherein the run mode of said process comprises the steps of:

(a) maintaining a substantially constant fluid flow in said steam generation coil;

(b) maintaining a substantially constant differential pressure value across said steam generation coil while monitoring both CO content in exiting flue gas and draft pressure below said convective section; and (c) controlling the combustion air supplied to said furnace to maintain said substantially constant differential pressure.

8. An improved furnace fuel optimizer for more effectively controlling fuel consumption in a furnace comprising a radiant section and a convective section containing an economizer coil by regulating the supply of combustion air to said furnace, wherein the improvement comprises:

(a) a CO analyzer which monitors CO content in exiting flue gas;

(b) a draft pressure transmitter which monitors draft below said convective section;

(c) a combustion air controller responsive to a computed optimum heat duty value for regulating air to said furnace;

(d) a flow transmitter positioned on an inlet line to said economizer coil;

(e) temperature transmitters positioned on said economizer coil inlet and outlet lines;

(f) computing means for computing said optimum heat duty value for operation of said furnace;

(g) transmission means for transmitting signals from said CO analyzer and from said temperature transmitters; and (h) means for transmitting said optimum heat duty value to said combustion air controller.

9. The improved furnace fuel optimizer as described in claim 8 wherein said economizer coil is a non-steaming boiler feed water economizer coil.

10. A process for more effectively controlling fuel consumption in a furnace comprising a radiant section and a convective section containing an economizer coil, wherein the furnace fuel optimizer comprises: a CO analyzer, a draft pressure transmitter and controller, a combustion air controller, a flow transmitter positioned on an inlet line to said economizer coil and temperature transmitters positioned on said economizer coil inlet and outlet lines, wherein the optimizing mode of said process comprises the steps of:

(a) supplying fluid to said economizer coil;

(b) firing said furnace to a desired operating temperature and pressure mode, having adequate draft and excess air;

(c) using said combustion air controller to gradually reduce air to said furnace;

(d) monitoring CO content in exiting flue gas with said CO analyzer;

(e) monitoring draft in said radiant section with said draft pressure transmitter;

(f) relaying said monitored CO content in the exiting flue gas to a control means having a preselected CO value;

(g) ceasing air reduction when said preselected CO value of said control means is met;

(h) calculating heat duty value ($Q_1$) by multiplying said input flow by specific heat of the flowing material times the difference of output temperature minus input temperature to obtain a heat duty value;

(i) multiplying said value by $M_2$ to obtain an optimum heat duty value, $M_2$ being a value which is greater than 1.0 but less than 3.0 which when multiplied by a heat duty value will yield a number (Q optimum) corresponding to a temperature which is: below said furnace specified maximum bridgewall temperature, below a maximum allowable tube skin temperature in said radiant section, and is at a temperature below where excessive flame impingement on said coils occurs; and (j) using said optimum heat duty value to control said furnace.

11. The improved furnace fuel optimizer as described in claim 10 wherein said economizer coil contains a fluid of constant composition incapable of undergoing a phase change under the present conditions.

12. A process for more effectively controlling fuel consumption in a furnace comprising a radiant section and a convective section containing an economizer coil, wherein the furnace fuel optimizer comprises: a CO analyzer, a draft pressure transmitter and controller, a combustion air controller, a flow transmitter positioned on an inlet line to said economizer coil and temperature transmitters positioned on said economizer coil inlet and outlet lines, wherein the run mode of said process comprises the steps of:

(a) maintaining a fluid flow in said economizer coil;

(b) maintaining a substantially constant heat duty value across said economizer coil while monitoring both CO content in exiting flue gas and draft pressure below said convective section; and (c) controlling the combustion air supplied to said furnace to maintain said substantially constant heat duty value.

13. An improved furnace fuel optimizer for more effectively controlling fuel consumption in a furnace comprising a radiant section and a convective section containing a steam generation coil by regulating the supply of combustion air to said furnace, wherein the improvement comprises:

(a) a CO analyzer which monitors CO content in exiting flue gas;

(b) a combustion air controller responsive to a computed optimum differential pressure value for regulating air to said furnace;

(c) flow controller means for controlling flow through said steam generation coil;

(d) a differential pressure transmitter connected across said steam generation coil inlet and outlet lines so as to monitor variations in differential pressure across said lines;

(e) computing means for computing said optimum differential pressure value for operation of the furnace;

(f) transmission means for transmitting signals from said CO analyzer and from said differential pressure transmitter to said computing means; and (g) means for transmitting said optimum differential pressure value to said combustion air controller.

14. An improved furnace fuel optimizer for more effectively controlling fuel consumption in a furnace comprising a radiant section and a convective section containing an economizer coil by regulating the supply of combustion air to said furnace, wherein the improvement comprises:

(a) a CO analyzer which monitors CO content in exiting flue gas;

(b) a combustion air controller responsive to a computed optimum heat duty value across said economizer for regulating air to said furnace;

(c) a flow transmitter positioned on a line connected to said economizer coil and temperature transmitters positioned on said economizer coil inlet and outlet lines;

(d) computing means for computing said optimum heat duty value across said economizer for operation of the furnace;

(e) transmission means for transmitting signals from said CO analyzer and from said temperature transmitters to said computing means; and (f) means for transmitting said optimum heat duty value to said combustion air controller.

15. A process for more effectively controlling fuel consumption in a furnace comprising a radiant section and a convective section containing a steam generation coil, wherein the furnace fuel optimizer comprises: a CO analyzer, a combustion air controller, a flow transmitter connected to a flow controller which is connected to an automatic control valve, and a differential pressure transmitter connected across said steam generation coil inlet and outlet lines, wherein the optimizing mode of said process comprises the steps of:

(a) supplying fluid to said steam generation coil;

(b) firing said furnace to a desired operating temperature and pressure mode, having excess air;

(c) using said combustion air controller to gradually reduce air to said furnace;

(d) monitoring CO content in exiting flue gas with said CO analyzer;

(e) relaying said monitored CO content in the exiting flue gas to a control means having a preselected CO value;

(f) ceasing air reduction when said preselected CO value of said control means is met;

(g) reading a corresponding value on said differential pressure transmitter;

(h) multiplying said value by $M_1$ to obtain an optimum differential pressure value, $M_1$ being a value which is greater than 1.0 but less than 3.0 which when multiplied by a differential pressure value will yield a number (DP optimum) corresponding to a value which is: below said furnace's specified maximum bridgewall temperature, below a maximum allowable tube skin temperature in said radiant section, and is at a value below where excessive flame impingement on said coil occurs; and (i) using said optimum differential pressure value to control said furnace.

16. A process for more effectively controlling fuel consumption in a furnace comprising a radiant section and a convective section containing an economizer coil, wherein the furnace fuel optimizer comprises: a CO analyzer, a combustion air controller, a flow transmitter positioned on an inlet line to said economizer coil and temperature transmitters positioned on said economizer coil inlet and outlet lines, wherein said optimizing mode of said process comprises the steps of:

(a) supplying fluid to said economizer coil;

(b) firing said furnace to a desired operating temperature and pressure mode, having adequate draft and excess air;

(c) using said combustion air controller to gradually reduce air to said furnace;

(d) monitoring CO content in exiting flue gas with said CO analyzer;

(e) relaying said monitored CO content in the exiting flue gas to a control means having a preselected value;

(f) ceasing air reduction when said preselected CO value of said control means is met;

(g) calculating heat duty value ($Q_1$) by multiplying said input flow by specific heat of the flowing material times the difference of output temperature minus input temperature to obtain a heat duty value;

(h) multiplying said value by $M_2$ to obtain an optimum heat duty value, $M_2$ being a value which is greater than 1.0 but less than 3.0 which when multiplied by a heat duty value will yield a number (Q optimum) corresponding to a temperature which is: below said furnace specified maximum bridgewall temperature, below a maximum allowable tube skin temperature in said radiant section, and is at a temperature below where excessive flame impingement on said coils occurs; and (i) using said optimum heat duty value to control said furnace.

* * * * *